United States Patent [19]

Howard et al.

[11] Patent Number: 4,602,235

[45] Date of Patent: Jul. 22, 1986

[54] TRANSFORMER ASSEMBLY WITH TERMINAL PLATES IN SUPPORT

[75] Inventors: Victor A. D. Howard, West Chicago; William A. Heitmanek, Elmhurst, both of Ill.

[73] Assignee: Micron Industries Corp., Stone Park, Ill.

[21] Appl. No.: 642,198

[22] Filed: Aug. 20, 1984

[51] Int. Cl.[4] ..... H01F 15/10

[52] U.S. Cl. ..... 336/192; 336/197

[58] Field of Search ..... 336/192, 198, 208, 210, 336/197; 310/71, 194

[56] References Cited

U.S. PATENT DOCUMENTS

| | | | |
|---|---|---|---|
| 1,884,385 | 10/1932 | Thardarson | 336/192 |
| 3,189,857 | 6/1965 | Jones | 336/192 X |
| 3,479,563 | 11/1969 | Roy | 336/192 X |
| 3,516,040 | 6/1970 | Ripley et al. | 336/192 X |
| 3,848,208 | 11/1974 | Dawson et al. | 336/192 X |
| 3,979,707 | 9/1976 | Prince, Jr. | 336/192 X |
| 4,423,399 | 12/1983 | Goodrich | 336/192 X |

FOREIGN PATENT DOCUMENTS

| | | | |
|---|---|---|---|
| 1213910 | 4/1966 | Fed. Rep. of Germany | 336/192 |
| 1539679 | 8/1969 | Fed. Rep. of Germany | 336/192 |
| 2146484 | 3/1973 | Fed. Rep. of Germany | 336/192 |
| 1126199 | 11/1956 | France | 336/192 |

*Primary Examiner*—Thomas J. Kozma

*Attorney, Agent, or Firm*—Leo J. Aubel; Robert E. Wagner; Lawrence J. Bassuk

[57] ABSTRACT

A transformer formed of a construction effectiving a relatively simple assembly including an L-shaped terminal support mountable in friction-fit relative between the transformer coil and the laminated core, and including terminal plates which are also snap-fit mounted in the support.

4 Claims, 9 Drawing Figures

TRANSFORMER ASSEMBLY WITH TERMINAL PLATES IN SUPPORT

DESCRIPTION

1. Technical Field

The present invention relates generally to transformer structures and more particularly to a transformer structure constructed in a simplified manner.

2. Background of the Invention and Prior Art

The present transformer is generally related to the transformer described in U.S. Pat. No. 3,516,040 entitled Transformer Structure. The present invention describes a transformer having generally similar electrical characteristics as the transformer described in said patent. However, the physical construction of the present transformer is much improved over, and is different than, that shown in said patent.

Transformers as disclosed in U.S. Pat. No. 3,516,040 include coil windings that encircle a center leg of an E-shaped core. A housing surrounds the coil and, terminal plates are mounted on the housing and electrically connected to the coil windings. The coil housing and the terminal block are molded from plastic material, and the conductive terminals are molded in place, and subsequently connected to the coil windings.

While the transformers as shown in said patent have had significant acceptance in the industry, the manufacturing process is time consuming and expensive because the various components are difficult to mold and difficult to assemble. Thus, in prior art units, the various components are usually formed in a plurality of separate pieces and are then assembled and subsequently encapsulated to provide a one piece structure. These types of units are expensive to manufacture and require relatively complicated manufacturing processing.

Thus, the present transformer is formed of a simpler construction including components which are easily assembled, and is relatively inexpensive to manufacture as compared to the prior art. The present invention includes all the well-known transformer components formed in a unique manner to provide a transformer which can be easily and conveniently assembled.

SUMMARY OF THE INVENTION

According to the present invention, a transformer assembly has been developed which can be produced and assembled conveniently, expeditiously and at reduced cost; and, which functions electrically equivalent to the prior art. The transformer structure includes a coil having a center opening, and a core having a leg which extends through the coil opening. One or more terminal blocks are assembled in friction-fit arrangement between the core and coil to securely mount the coil on the core, simply and efficiently. The terminal blocks are constructed so that the terminal connectors can easily be snap fitted into place without an additional tooling or fixture.

The foregoing features and advantages of the present invention will be apparent from the following more particular description of the invention. The accompanying drawings herein are useful in explaining the invention wherein:

DESCRIPTION OF THE INVENTION

Figure 1:
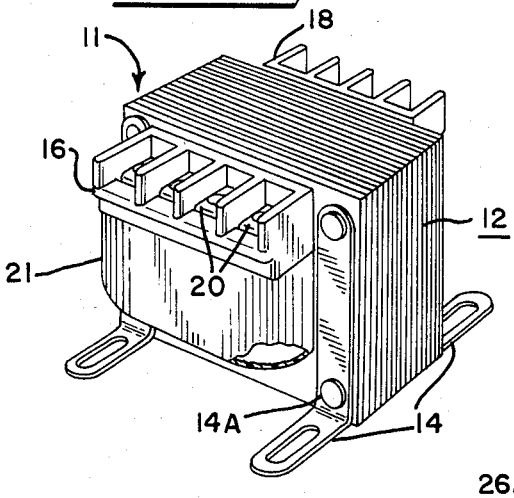
FIG. 1 is an isometric view of the inventive transformer.
Figure 2:
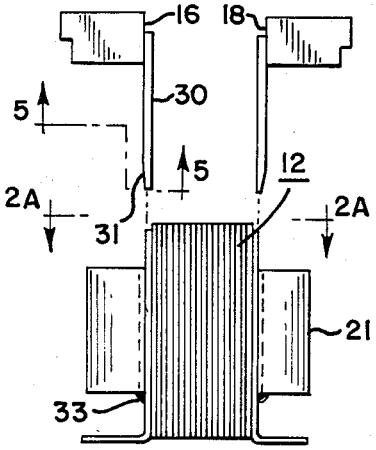
FIG. 2 is an exploded side view of the transformer of FIG. 1 to show the manner of inserting the terminal support.
Figure 5:
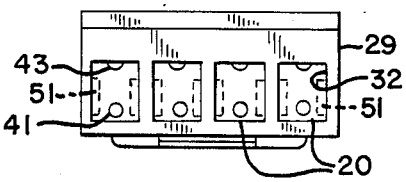
FIG. 5 is a view taken along the lines 5—5 of FIG. 2.

Refer first to FIG. 1 which shows an isometric view of one embodiment of the assembled inventive transformer 11. Transformer 11 includes a conventional E-shaped laminated magnetic core 12 of rectangular dimensions, seen also in FIG. 2B. As is known, core 12 comprises a plurality of interleaved laminations in which adjacent laminations are positioned in reverse orientation to form a closed frame 15 having a center leg 17 and spaced windows 19 which receive a coil 21 such as in the form of a toroid.

Coil 21 is formed, and the E-shaped laminations of the core 12 are inserted and mounted together, to have the center member leg 17 of core 12 extend through the coil opening 24, and with the side legs or members 25 and 27 of the core surrounding the coil 21.

Figure 2A:
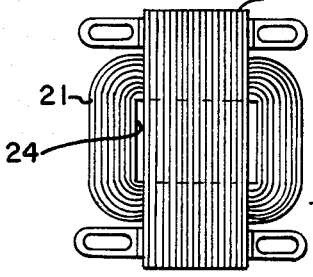
FIG 2A is a top view taken along line 2A—2A to show the spacing between the coil and the core into which the terminal supports are inserted.
Figure 2B:
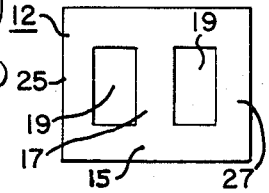
FIG. 2B is a sketch indicating the E-shape construction of core of FIG. 1.

It is of particular importance in the present construction that the coil 21 be dimensioned to include a center or central opening 24, as shown in FIG. 2A. In the embodiment shown, opening 24 is substantially rectangular in shape and the edges of opening 24 extends slightly past the side surfaces of core 12, for purposes to be described. It should be understood that while an embodiment of the invention is described which utilizes an E-shaped core, the invention is not limited to an E-shaped core, and is applicable universally to a transformer wherein a coil, or coils, surrounds a portion of a core.

Transformer 11 includes suitable means, such as brackets 14 affixed to the core 12 as by screws 14A, for mounting the transformer on an associated base, not shown. Transformer 11 also includes a pair of terminal supports 16 and 18 made of an insulative material, see also FIGS. 2 and 4. The supports 16 and 18 each carry a number of terminal plates, generally designated as 20, for providing electrical connections to the coil 21 through coil winding leads 22 (see FIG. 3) to the external wiring 26 (see FIG. 4). The supports 16 and 18, and the terminal plates 20 comprise an important feature of the invention and will be described in detail hereinafter.

Figure 4:
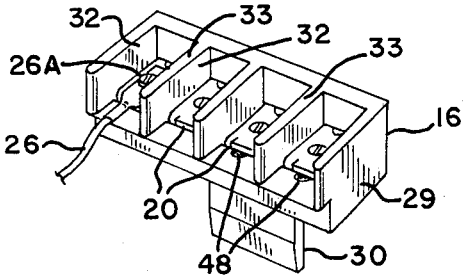
FIG. 4 is a isometric view of a terminal support.

The outer form or outline of the terminal supports 16 and 18 is clearly seen in FIGS. 2 and 4. The supports 16 and 18 are identical and are positioned in transformer 11 in back-to-back relation. A description of support 16 will be given and it is understood it applies also to support 18. Support 16 includes a rectangular box-like body portion 29, and a downwardly extending flat rectangular leg 30 and the lower end of the leg 30 is tapered as at 31. Leg 30 is molded as a part of the body portion 29. Body portion 29 is formed to have individual compartments generally labeled 32, separated by walls 33 to provide electrical isolation between the terminal plates 20 which are mounted therein.

To assemble the terminal supports 16 and 18 with the core 12 and coil 21, the legs 30 are inserted, and wedged, into the spaces of opening 24, (see FIG. 2A), as indicated in the exploded view of FIG. 2. The legs 30 are thus inserted in opening 24 in friction fit relation between the inside surface of coil 21 and the side surfaces of the core 12. The wedge 31, formed at the lower end of leg 30, facilities the entry of the leg 30 into its associated space in opening 24. After the legs 30 are inserted in position an epoxy or adhesive compound 33 is deposited in and around the opening 24 to assist in retaining the legs 30 in position.

Figure 3:
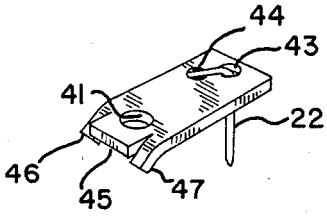
FIG. 3 is an isometric view of a terminal plate.

Refer now to FIG. 3 and the drawings relating to the terminal plates 20. As shown in FIG. 3, the terminal plates 20 each comprise a flat rectangular plate having a pair of spaced holes 43 and 41. Hole 41 receives a screw for attaching a connector terminal of an external wire 26 to plate 20 (see also FIG. 4). Hole 43 receives a coil winding lead 22 which is insertable from underneath the plate 20 and then conveniently soldered or welded on top of the plate, as at 44. The forward edge of plate 20 is struck to effectively form a center flat portion 45 and two downwardly projecting tines 46 and 47 straddling the flat portion, for purposes to be described.

Each of the compartments 32 of terminal support 16 are similar and the description and positioning of a terminal plate 20 in one compartment 32 will equally be applicable to all the plates and compartments. It will of course, be appreciated that while four compartments are indicated in FIG. 4, the terminal block 16 may be of any suitable size, and the number of compartments may be varied.

Figure 6:
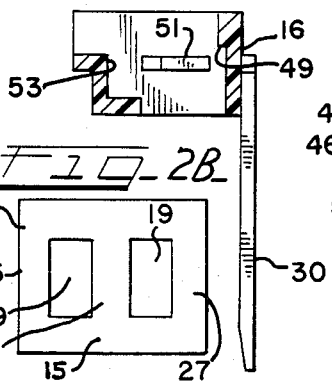
FIG. 6 is a side view partly in cross section of a terminal support.
Figure 7:
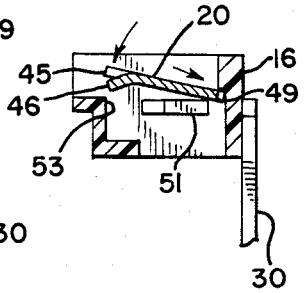
FIG. 7 is a side view showing the mounting or positioning of the terminal plate in the terminal support.

The interior formation of a compartment 32 is best seen in FIG. 6 which is a side view partially in cross section of a compartment. Compartment 32 has an overhang 49 on its back wall, and two side ledges 51 on opposite sides of the compartment which extend inwardly into the compartment 32. A retaining ledge and support wall 53 extends inwardly from the front of the compartment. As seen in FIG. 7, the end and upper surface terminal plate 20 fits below overhang 49 and engages or braces against the top surface of ledges 51. The tines 47 of plate 20 are snap-fitted and wedged into the side of support wall 53, and the center portion 46 of plate 20 rests on the top of support wall 53 to provide an assembly as shown in FIG. 4 wherein the plates 20 are securely positioned in their respective compartments. After the terminal plates 20 are snap-fitted in position, an epoxy or adhesive compound may be deposited as at 48 to more securely adhere plate 20 to the support 16.

As mentioned above, the coil winding leads 22 may be brought upward and outwardly (as oriented in FIG. 3) so that the leads can be conveniently soldered or welded, as at 44, on the outward or top surface of the plates 20 such as by automatic means. The external leads 26 may be affixed to plates 20 such as by screws 26A. The body portion 29 of terminal blocks 16 and 18 prevent the screws 26A from contacting the coil windings. Note that the individual plates 20 can be removed and replaced if required, and that the plates 20 are essentially universal; that is the plates are adaptable for any size terminal or wire lead.

Note, that for certain applications to better connect to external wiring or because of space limitations, it may be desirable to orient terminal supports 16 and 18 in relative upside down position. That is, terminal support 16 may be inserted into and mounted in spacing 24 downwardly from the top of the coil 21, as indicated in FIG. 2; and, terminal support 18 may be turned upside down and inserted and mounted upwardly from the bottom of the coil.

It has also been found that a single terminal support may be utilized in the inventive structure. Thus, for example, and referring particularly to FIGS. 2 and 2A, only one support 16 with the associated terminal plates is inserted into the central coil opening 24 to wedge between coil 24 and core 12. In this latter case, the coil opening 24 may be made somewhat smaller, (in a horizontal direction as oriented in FIG. 2A) or the leg 30 may be made thicker. The foregoing structure will provide a friction tight fit between the inner surface of coil 21 and the adjacent surface of core 12 to obtain a solid, rigid assembly, as described above.

It is apparent that the foregoing components of the transformer 11 can be conveniently, easily and inexpensively assembled to provide a transformer of solid, serviceable and rigid construction. Note that the transformer of the invention is not limited to any particular physical size or any given electrical characteristic and may be used as a universal transformer construction.

While the invention has been particularly shown and described with reference to a preferred embodiment thereof, it will be understood by those skilled in the art, that various changes in form and details may be made therein without departing from the spirit and scope of the invention.

We claim:

1. A transformer comprising:

a core having an extending member or leg;

a coil winding positioned around said leg and including connecting leads, and forming a spacing between the core and the inner surface of said coil winding;

an inverted L-shaped terminal support of non-conductive material having an upper body portion and a downwardly-extending leg, said downwardly-extending leg being received in friction-fit relation between said core and coil in said spacing;

said body portion being sub-divided into a plurality of compartments;

terminal plates conforming substantially to the size of said compartments, each of said plates including a front end having a flat section and downwardly-angled tines, said compartments having a front wall providing an upper support surface and a vertical surface, a back wall and side walls, said back wall including an overhang for engaging the back portion of said plate along its upper surface, said downwardly-angled tines being wedged and snapfittable against the vertical surface of said front wall, and said flat section engaging the upper surface of said front wall to thereby position said plates securely in respective compartments.

2. An apparatus as in claim 1, wherein said compartments have a substantially rectangularly-shape;

said flat section of said plates located centrally and said downwardly-angled tines straddling said flat section.

3. An apparatus as in claim 1, further including ledges on said side walls for engaging the sides of said plates along the lower surface of said plates.

4. An apparatus as in claim 1, wherein said terminal plates include an opening for receiving associated leads which may be inserted to extend outwardly to enable soldering or welding of said leads thereon.

* * * * *